United States Patent [19]

Johnston

[11] 4,254,777

[45] Mar. 10, 1981

[54] BRASSIERE FOR STRENUOUS PHYSICAL ACTIVITY

[76] Inventor: Elizabeth D. Johnston, 935 NW. 13th Ave., Gainesville, Fla. 32601

[21] Appl. No.: 963,069

[22] Filed: Nov. 22, 1978

[51] Int. Cl.[3] ..... A41C 3/07

[52] U.S. Cl. ..... 128/465

[58] Field of Search ..... 128/465, 500, 520, 426, 128/425, 427, 510; 2/44, 45, 267, 268

[56] References Cited

U.S. PATENT DOCUMENTS

| | | | |
|---|---|---|---|
| 2,703,488 | 3/1955 | Roth | 128/427 |
| 3,220,415 | 11/1965 | Marino | 128/510 |
| 3,606,891 | 9/1971 | Marcario et al. | 128/500 |
| 4,026,547 | 5/1977 | Silverstolpe et al. | 2/44 |

*Primary Examiner*—Doris L. Troutman

[57] ABSTRACT

A brassiere for wearing during strenuous physical activity to prevent undue movement by the use of extra facing around the cups, providing extra comfort for the wearer by using wide, padded straps over the shoulder of the wearer in addition to facilitating breathing by a stretchable mid-back panel which does not constrict the chest.

4 Claims, 5 Drawing Figures

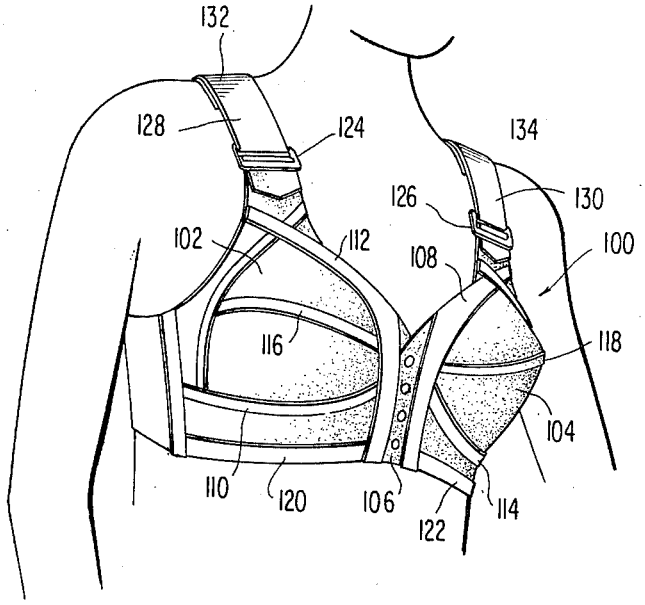
FIG. 4
FIG. 5
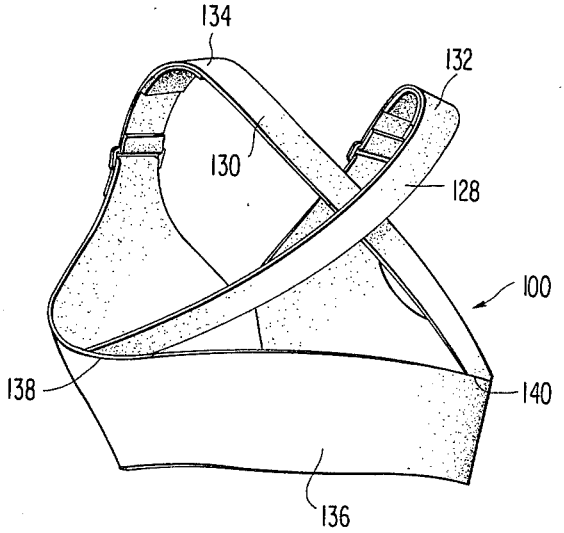

BRASSIERE FOR STRENUOUS PHYSICAL ACTIVITY

This invention relates to brassieres and more particularly to brassieres worn during strenuous physical activity.

It is well known that size, age, and a rapid weight gain or loss may contribute to the stretching of the muscles which support the breasts of the human female. When this stretching takes place the result is an unsightly sagging of the breasts and accompanying discomfort, often resulting in an emotional distress of the woman. This syndrome of sagging breasts, medically known as "Cooper's Droop", is most pronounced in large breasted women where the breast's greater weight increases the tendency to sag. Not only is the tendancy to sag more acute in large breasted women, its effect is much more traumatic.

Brassieres are utilized to structurally uplift the breasts, and thus counteract Cooper's Droop. For general light activities where the only significant force acting on the breasts is gravitational weight, conventional brassieres are adequate to prevent or minimize Cooper's Droop. However, when conventional brassieres are worn during strenuous physical activity, the added forces on the breasts caused by the motion of the woman's body counteract the restraining properties of the brassiere. Hence, Cooper's Droop continues to plague athletic women wearing conventional brassieres who experience discomfort during the activity because the motion of their breasts is not sufficiently inhibited.

Usually these conventional brassieres are intended to be worn as underwear, and if worn by themselves on the upper torso of a woman engaged in physical activities, such as jogging, would render her subject to ridicule and perhaps even arrest for indecent exposure. Thus, an outer covering must be worn that increases the discomfort for the wearer by making her hot, besides adding undesired weight and stress which must be supported by the brassiere. Another source of discomfort in conventional brassieres is the narrow shoulder straps which are used that tend to gouge into the shoulders of the wearer during physical exercise.

Although conventional brassieres have been at least partially successful in preventing Cooper's Droop, they also tend to excessively restrict the upper torso of the wearer. When wearing such a device during strenuous physical activity, a woman would have to breathe excessively hard to overcome the constricting effect of a conventional brassiere on the wearer's chest cavity.

Hence, it can be seen that there is a need for a brassiere which will effectively prevent Cooper's Droop in large breasted women, will effectively prevent discomfort from excessive breast movement in women of all breast sizes, can be worn without additional outer clothing causing over-heating of the wearer, does not inhibit the breathing of the wearer during strenuous physical exercise, and which will not cause discomfort on the shoulders of the wearer.

The present invention fulfills all of these needs with a brassiere which provides support for the breasts of a woman, even during strenuous physical exercise, by having extra facing around the cups thereof. Additionally, a brassiere constructed in accordance with the present invention has a stretchable back panel so as to allow the chest cavity to expand normally while breathing, even during strenuous physical exercise. The present invention also includes the use of wide, padded straps going over the shoulders of the wearer to prevent discomfort from gouging straps, even during strenuous physical exercise. Further, the present invention provides a brassiere which can be made in colored designs and prints so that it can be worn as an external garment in public without other outer clothing.

FIG. 4 is a front perspective view of another embodiment of the invention; and,

FIG. 5 is a back perspective view of the embodiment illustrated in FIG. 4.

Figure 1:
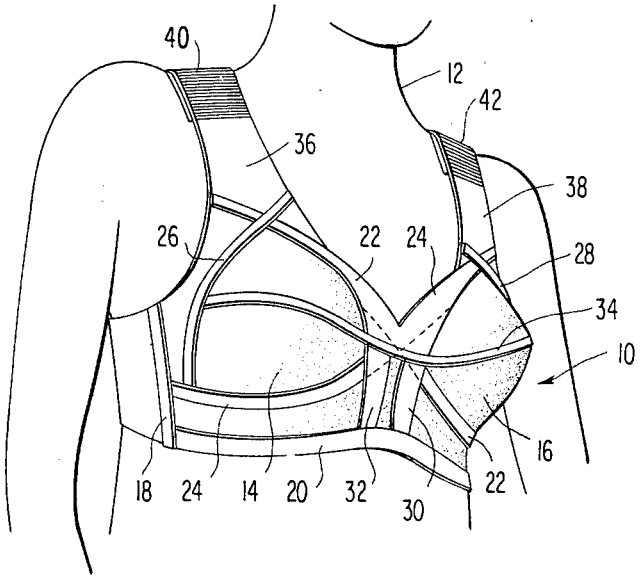
FIG. 1 is a front perspective view of one embodiment.

A brassiere 10 of the present invention effectively prevents excessive motion of the breasts of a wearer 12, even during strenuous physical activity. It accomplishes this result by having extra facing around the cups 14 and 16 so as to restrict the motion of the breasts held within these cups. This facing is added to the cups in a symmetrical arrangement. The facing includes side strips 18, bottom strip 20, criss-cross strips 22 and 24 (partially displayed in dotted line to show the underlying structure), outer strips 26 and 28, central strips 30 and 32, and contour strip 34. These facing strips serve to reinforce the cup structure, and anchor it to the brassiere, so that the breasts are not unduly displaced even during strenuous physical actitivy.

Cups 14 and 16 are preferably made of 100% nylon while the facing is preferably nylon and spandex, although any other suitable fabric may be used.

Additionally, brassiere 10 is provided with wide straps 36 and 38 which do not cut into the shoulders of wearer 12, because of their width. Straps 36 and 38 are provided with padded sections 40 and 42 to further increase the comfort for the wearer. These straps are preferably made of nylon with 100% cotton padding.

Figure 2:
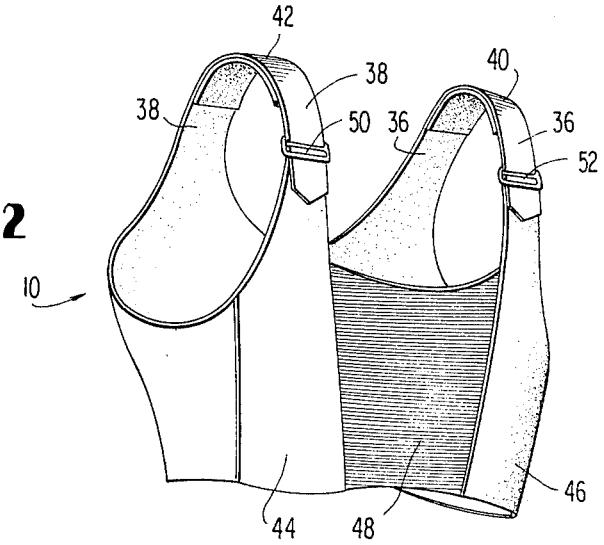
FIG. 2 is a back perspective view of the embodiment illustrated in FIG. 1.

As seen from the back in FIG. 2, brassiere 10 is provided with no-stretch strap panels 44 and 46, which form continuous structures with straps 36 and 38. This material is preferably nylon. The non-stretch material of strap panels 44 and 46 help to insure that straps 36 and 38 will not be displaced due to stretching. On the other hand, mid panel 48 is made of a stretchable material (preferably rubber and nylon with cotton lining) so that when the wearer 12 breathes (particularly during strenuous physical activity) the stretchable panel 48 can "give" so as to facilitate the breathing activity. Straps 36 and 38 can be provided at any suitable location (shown in FIG. 2 as 50 and 52) with conventional adjustments, so that the length of the straps can be altered to fit the size of the individual wearer 12.

Figure 3:
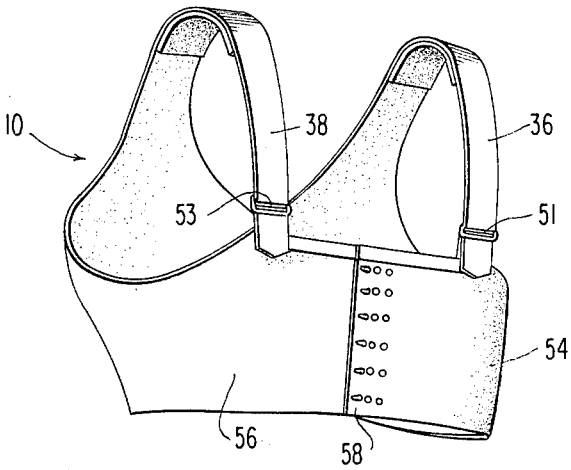
FIG. 3 is a back perspective view of an alternative embodiment.

In an alternative embodiment of the invention, the front is the same as that of the embodiment shown in FIG. 1. The back, however, is as shown in FIG. 3. Straps 36 and 38 have adjustable connections 51 and 53 similar to the adjustments 50 and 52 of the first embodiment. These adjustable connections can be any of the well known fastening methods known to the art such as plastic buckles, buttons, or hooks. Additionally, back portions 54 and 56 are connected by three adjustable rows of hooks as shown by one exposed row 58. Back portions 54 and 56 are of stretchable material, so that the breathing of wearer 12 is not inhibited by the wearing of brassiere 10. The preferred materials used in this embodiment are the same as those in the first embodiment with the exception of non-stretchable panels 44 and 46 which have been omitted.

Another embodiment is shown in FIGS. 4 and 5. In FIG. 4 the reinforcing facing around the cups of brassiere 100 is substantially similar to the facing of the first embodiment shown in FIG. 1. However, brassiere 100 of FIG. 4 is divided between cups 102 and 104, and has been provided with closure means shown as buttons 106 between these cups. Hence, the criss-cross facing of this embodiment appears as four strips. Strips 108 and 110 provide one criss-cross, while strips 112 and 114 provide the other. Additionally, the contour strip of this embodiment is composed of two strips, 116 and 118. Further, the bottom strip is made up of strips 120 and 122.

This embodiment is also provided with conventional strap adjustments 124 and 126. Straps 128 and 130 of this embodiment also are wider than normal brassiere straps and again have been provided with padding 132 and 134 to provide extra comfort for the wearer.

As shown in FIG. 5 straps 128 and 130 cross each other in the back and are attached to stretchable back panel 136 to form wide side portions 138 and 140. Back panel 136 is stretchable in order to prevent any inhibition of breathing of the wearer of brassiere 100. The preferred materials for this embodiment are the same as those for the other two embodiments.

The brassiere of the present invention has been disclosed as three presently preferred embodiments, each of which may be manufactured in colored design or prints so that it may be worn with or without other outer clothing, as the wearer desires.

While the invention has been disclosed in terms of distinct embodiments, the scope of the invention should not be deemed to be limited by the precise embodiments or modifications as described and illustrated, since other embodiments or modifications are intended to be reserved within the scope of the appended claims.

What is claimed is:

1. A brassiere for providing support for the breasts of a wearer comprising, a. a front having a right cup and a left cup wherein said front is provided with (1) first reinforcing facings extending from the top of said front below each armpit of said wearer to the bottom of said front, (2) second reinforcing facing extending from said first reinforcing facing beside said right cup along the bottom of said front to said first reinforcing facing beside said left cup, (3) third reinforcing facing extending from the top of said right cup across said front, under said left cup to said first reinforcing facing beside said left cup, (4) fourth reinforcing facing extending from the top of said left cup across said front, under said right cup to said first reinforcing facing beside said right cup, (5) fifth reinforcing facing extending from the top of each of said cups across said front between said cups to said second reinforcing facing between said cups, (6) sixth reinforcing facing extending from the top of said right cup along the right side of said right cup to said fourth reinforcing facing, (7) seventh reinforcing facing extending from the top of said left cup along the left side of said left cup to said third reinforcing facing, (8) eight reinforcing facing extending from said sixth reinforcing facing across the outer contour of said right cup and said left cup to said seventh reinforcing facing, b. a back panel extending from the side of said first reinforcing facings around the back of said wearer, and c. wide straps extending from the top of said cups over the shoulders of said wearer to the top of said back panel.

2. A brassiere according to claim 1 wherein said back panel is stretchable.

3. A brassiere according to claim 1 wherein said wide straps are provided with padding where they pass over the said shoulders.

4. A brassiere according to claim 1 wherein said back panel comprises:

a. Non-stretchable material from where each of said wide straps meet said back panel to the bottom of said back panel, and b. stretchable material between said non-stretchable materials.

* * * * *